US009028091B2

(12) United States Patent
Holland et al.

(10) Patent No.: US 9,028,091 B2
(45) Date of Patent: May 12, 2015

(54) LOW PROFILE LIGHT HAVING ELONGATED REFLECTOR AND ASSOCIATED METHODS

(71) Applicant: Lighting Science Group Corporation, Satellite Beach, FL (US)

(72) Inventors: Eric Holland, Indian Harbour Beach, FL (US); Mark Penley Boomgaarden, Satellite Beach, FL (US); Ryan Kelley, Denver, CO (US)

(73) Assignee: Lighting Science Group Corporation, Melbourne, FL (US)

( * ) Notice: Subject to any disclaimer, the term of this patent is extended or adjusted under 35 U.S.C. 154(b) by 129 days.

(21) Appl. No.: 13/800,253

(22) Filed: Mar. 13, 2013

(65) Prior Publication Data

US 2013/0223055 A1 Aug. 29, 2013

Related U.S. Application Data

(63) Continuation-in-part of application No. 13/676,539, filed on Nov. 14, 2012, which is a continuation-in-part of application No. 13/476,388, filed on May 21, 2012, now Pat. No. 8,672,518, which is a (Continued)

(51) Int. Cl.
*F21V 33/00* (2006.01)
*F21V 7/00* (2006.01)
(Continued)

(52) U.S. Cl.
CPC ..... *F21V 7/005* (2013.01); *F21V 29/22* (2013.01); *F21V 29/2212* (2013.01); *F21S 8/026* (2013.01); *F21S 8/04* (2013.01); *F21V 5/00* (2013.01); *F21V 7/0008* (2013.01); *F21V 9/08* (2013.01); *F21V 13/04* (2013.01); *F21V 15/01* (2013.01);
(Continued)

(58) Field of Classification Search
USPC ..... 362/218, 217.07, 249.02, 235, 238, 362/245, 247, 294; 315/291
See application file for complete search history.

(56) References Cited

U.S. PATENT DOCUMENTS 6,290,382 B1 9/2001 Bourn et al.
6,370,168 B1 4/2002 Spinelli
(Continued)

FOREIGN PATENT DOCUMENTS

EP 1950491 7/2008
WO WO2008137732 11/2008

OTHER PUBLICATIONS

U.S. Appl. No. 13/676,539, filed Nov. 2012, Holland et al.
(Continued)

*Primary Examiner* — Ali Alavi
(74) *Attorney, Agent, or Firm* — Mark R. Malek; William A. Harding; Widerman Malek, PL

(57) ABSTRACT

A luminaire to be carried by a lighting fixture. The luminaire may include a housing, a primary optic disposed within the housing having a reflective inner surface defining an optical chamber, a light source, and a heat sink defining an aperture through which light may propagate. The light source may include a plurality of light-emitting diodes (LEDs). The luminaire may further include a secondary optic positioned adjacent to the light source that may collimate and/or refract light emitted by the light source, and may form a seal between the light source and the optical chamber. The luminaire may further include a color conversion layer configured to change the color of light emitted by the light source.

5 Claims, 8 Drawing Sheets

Related U.S. Application Data continuation-in-part of application No. 12/775,310, filed on May 6, 2010, now Pat. No. 8,201,968.

(60) Provisional application No. 61/248,665, filed on Oct. 5, 2009.

(51) Int. Cl.

| | |
|---|---|
| ***F21V 29/00*** | (2006.01) |
| ***F21S 8/02*** | (2006.01) |
| ***F21S 8/04*** | (2006.01) |
| ***F21V 5/00*** | (2006.01) |
| ***F21V 9/08*** | (2006.01) |
| ***F21V 15/01*** | (2006.01) |
| ***F21V 23/00*** | (2006.01) |
| ***F21V 23/02*** | (2006.01) |
| ***F21V 23/04*** | (2006.01) |
| *F21V 13/04* | (2006.01) |
| *F21V 21/02* | (2006.01) |
| *F21V 21/04* | (2006.01) |
| *F21Y 101/02* | (2006.01) |
| *F21Y 103/02* | (2006.01) |
| *F21Y 113/00* | (2006.01) |

(52) U.S. Cl.

CPC ..... *F21V 21/02* (2013.01); *F21V 21/04* (2013.01); *F21V 23/002* (2013.01); *F21V 23/026* (2013.01); *F21V 23/04* (2013.01); *F21V 23/0471* (2013.01); *F21Y 2101/02* (2013.01); *F21Y 2103/022* (2013.01); *F21Y 2113/005* (2013.01)

(56) References Cited

U.S. PATENT DOCUMENTS

| | | | | |
|---|---|---|---|---|
| 6,542,671 | B1 | 4/2003 | Ma et al. | |
| 6,641,284 | B2 * | 11/2003 | Stopa et al. | 362/240 |
| 6,893,140 | B2 | 5/2005 | Storey et al. | |
| 6,945,672 | B2 | 9/2005 | Du et al. | |
| 7,148,632 | B2 * | 12/2006 | Berman et al. | 315/189 |
| 7,306,352 | B2 | 12/2007 | Sokolov et al. | |
| 7,344,280 | B2 | 3/2008 | Panagotacos et al. | |
| 7,906,722 | B2 | 3/2011 | Fork et al. | |
| 7,978,282 | B2 * | 7/2011 | An et al. | 349/58 |
| 8,038,314 | B2 | 10/2011 | Ladewig | |
| 8,201,968 | B2 | 6/2012 | Maxik et al. | |
| 8,272,763 | B1 | 9/2012 | Chinnam et al. | |
| 8,297,798 | B1 | 10/2012 | Pittman et al. | |
| 8,807,784 | B2 * | 8/2014 | Marquardt et al. | 362/218 |
| 2002/0151941 | A1 | 10/2002 | Okawa et al. | |
| 2005/0033119 | A1 | 2/2005 | Okawa et al. | |
| 2007/0041167 | A1 | 2/2007 | Nachi | |
| 2007/0291483 | A1 * | 12/2007 | Lys | 362/227 |
| 2008/0170398 | A1 | 7/2008 | Kim | |
| 2008/0232116 | A1 | 9/2008 | Kim | |
| 2009/0086474 | A1 | 4/2009 | Chou | |
| 2009/0141506 | A1 | 6/2009 | Lan et al. | |
| 2009/0310348 | A1 * | 12/2009 | Laski et al. | 362/231 |
| 2011/0051414 | A1 * | 3/2011 | Bailey et al. | 362/235 |
| 2011/0205738 | A1 | 8/2011 | Peifer et al. | |
| 2012/0002411 | A1 | 1/2012 | Ladewig | |
| 2012/0051041 | A1 | 3/2012 | Edmond et al. | |
| 2012/0106144 | A1 | 5/2012 | Chang | |
| 2012/0140461 | A1 | 6/2012 | Pickard et al. | |
| 2012/0201034 | A1 | 8/2012 | Li | |
| 2012/0262902 | A1 | 10/2012 | Pickard et al. | |
| 2012/0262921 | A1 | 10/2012 | Boomgaarden et al. | |
| 2012/0327650 | A1 | 12/2012 | Lay et al. | |
| 2013/0021792 | A1 | 1/2013 | Snell et al. | |
| 2013/0021803 | A1 | 1/2013 | Pickard et al. | |
| 2013/0335962 | A1 | 12/2013 | Wu et al. | |

OTHER PUBLICATIONS

EP International Search Report for Application No. 10174449.8; (Dec. 14, 2010).

* cited by examiner

LOW PROFILE LIGHT HAVING ELONGATED REFLECTOR AND ASSOCIATED METHODS

RELATED APPLICATIONS

This application is a continuation-in-part of U.S. patent application Ser. No. 13/676,539 titled Low Profile Light Having Concave Reflector and Associated Methods filed on Nov. 14, 2012, which is in turn a continuation-in-part of U.S. patent application Ser. No. 13/476,388 titled Low Profile Light and Accessory Kit For The Same filed on May 21, 2012, which is in turn a continuation-in-part of U.S. patent application Ser. No. 12/775,310, now U.S. Pat. No. 8,201,968, titled Low Profile Light filed on May 6, 2010, which claims the benefit of U.S. Provisional Patent Application Ser. No. 61/248,665 filed Oct. 5, 2009, the entire contents of each of which are incorporated herein by reference.

FIELD OF THE INVENTION

The present invention relates to luminaires that reflect light emitted by light-emitting elements and, more specifically, to luminaires used to replace linear fluorescent lamps, and associated methods.

BACKGROUND OF THE INVENTION

A fluorescent lamp (also called a fluorescent tube) uses electrical current to excite a vapor within a glass tube resulting in the discharge of electrons. Visible light is produced when the electrons cause a material coating the inner wall of the glass tube to fluoresce. Linear fluorescent lamps are routinely used in commercial or institutional buildings, and are commonly installed in troffer light fixtures (recessed troughs installed in a ceiling) and pendant light fixtures (housings suspended from a ceiling by a chain or pipe).

Fluorescent lamps have been steadily replacing incandescent lamps in many lighting applications. Compared to an incandescent lamp, a fluorescent lamp converts electrical power into useful light more efficiently, delivers a significantly longer useful life, and presents a more diffuse and physically larger light source. However, fluorescent lamp technology has disadvantages. A fluorescent lamp is typically more expensive to install and operate than an incandescent lamp because the fluorescent lamp requires a ballast to regulate the electrical current. Fluorescent light fixtures cannot be connected directly to dimmer switches intended for incandescent lamps, but instead require a compatible dimming ballast. The performance of fluorescent lamps may be negatively impacted by environmental conditions such as frequent switching and operating temperatures. Many fluorescent lamps have poor color temperature, resulting in a less aesthetically pleasing light. Some fluorescent lamps are characterized by prolonged warm-up times, requiring up to three minutes before maximum light output is achieved. Also, if a fluorescent lamp that uses mercury vapor is broken, a small amount of mercury (classified as hazardous waste) can contaminate the surrounding environment.

Digital lighting technologies such as light-emitting diodes (LEDs) offer significant advantages over traditional linear fluorescent lamps. These include but are not limited to better lighting quality, longer operating life, and lower energy consumption. Increasingly, LEDs are being designed to have desirable color temperatures. Moreover, LEDs do not contain mercury. Consequently, a market exists for LED-based retrofit alternatives to legacy lighting fixtures that use fluorescent lamps. However, a number of installation challenges and costs are associated with replacing linear fluorescent lamps with LED illumination devices. The challenges, which are understood by those skilled in the art, include light output, thermal management, and ease of installation. The costs, which are similarly understood by those skilled in the art, typically stem from a need to replace or reconfigure a troffer or pendant fixture configured to support fluorescent lamps to support LEDs instead.

By the very nature of their design and operation, LEDs have a directional light output. Consequently, the light emitted by an LED may not have the nearly omni-directional and uniform light distribution of incandescent and fluorescent lamps. Although multiple LEDs can be used in a single lamp, lighting solutions employing LEDs do not have light distribution properties approximating or equaling the dispersion properties of traditional lamps.

Another challenge inherent to operating LEDs is heat. Thermal management describes a system's ability to draw heat away from the LED, either passively or actively. LEDs suffer damage and decreased performance when operating in high-heat environments. Moreover, when operating in a confined environment, the heat generated by an LED and its attending circuitry itself can cause damage to the LED. Heat sinks are well known in the art and have been effectively used to provide cooling capacity, thus maintaining an LED-based light bulb within a desirable operating temperature. However, heat sinks can sometimes negatively impact the light distribution properties of the light fixture, resulting in non-uniform distribution of light about the fixture.

Power supply requirements of LED-based lighting systems can complicate installation of LEDs as a retrofit to existing light fixtures. LEDs are low-voltage light sources that require constant DC voltage or current to operate optimally, and therefore must be carefully regulated. Too little current and voltage may result in little or no light. Too much current and voltage can damage the light-emitting junction of the LED. LEDs are commonly supplemented with individual power adapters to convert AC power to the proper DC voltage, and to regulate the current flowing through during operation to protect the LEDs from line-voltage fluctuations.

A need exists for a troffer-retrofit luminaire that may be employed within the volume of space available in an existing troffer and pendant light fixture, and that delivers improved lighting quality compared to traditional LED troffers. More specifically, a need exists for a troffer-based lighting solution that benefits from the advantages of digital lighting technology, while exhibiting better cut-off and reduced glare than legacy troffer solutions. Additionally, a need exists for a luminaire designed for ease of installation as well as for manufacturing cost reduction. The lighting industry is experiencing advancements in LED applications, some of which may be pertinent to certain aspects of replacing linear fluorescent lamps.

U.S. patent application Ser. No. 12/712,743 by Peifer et al. is directed to a troffer-style light fixture using LEDs to cross-light internal surfaces of the troffer, causing light from opposite LED modules to mix as light is emitted from the fixture. However, this cross-lighting solution still employs separate LEDs pointing generally downward. Such a design is known in the art to create bright and dark spaced spots onto an illuminated surface, and also to emit light with poor cutoff.

U.S. Pat. No. 8,038,314 to Ladewig discloses a troffer-style luminaire having an interior region defined by two sides and a top extending between the sides. Indirect LEDs are coupled along interior surfaces of the sides, within the interior region. However, the luminaire is characterized by LED-support means (i.e., the interior surfaces of the sides) that are separate and distinct from thermal management means (e.g., exterior heat sink). This design adds to manufacturing cost due to material and complexity.

U.S. Pat. No. 8,297,798 to Pittman et al. discloses a lighting fixture having a reflector, a pedestal projecting through an opening substantially central to the reflector, and a lighting module mounted on the pedestal. The lighting module includes a frame and indirect LEDs that emit light toward the interior surface of the reflector. However, positioning of the lighting module obscures the reflector section opposite the frame as perceived from any point external to the luminaire.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a luminaire adapted to be carried by a lighting fixture. The luminaire may include a housing, a primary optic, a light source, and a heat sink.

The housing may have a generally concave elongated shape. The primary optic may be carried by the housing, and may have a reflective inner surface that defines an optical chamber and an aperture. The light source may be positioned adjacent the optical chamber so as to be obscured from view from any point external to the luminaire. The heat sink may be in thermal communication with the light source and/or the housing, and may be positioned at least partially outside of the housing. The luminaire also may have hanger holes configured to attach the housing and/or an outer surface of primary optic to an external light fixture.

The light source may have a printed circuit board upon which light-emitting diodes (LEDs) may be disposed. Light emitted by the light source may enter the optical chamber, where the light may reflect off of the reflective inner surface of the primary optic and through the aperture. The reflective inner surface of the primary optic may reflect light at an intensity of at least about 95% of the original intensity of the incident light.

A first set of the LEDs may emit light having a first color, and a second set of the LEDs may emit light having a second color. Both the first and second sets of LEDs may be of a color type such as hyper-red, red, amber, yellow, true green, blue, and deep blue. Alternatively, the first set of LEDs may be of a color type such as hyper-red, red, amber, yellow, true green, blue, and deep blue; and the second set of LEDs may be of a white type such as blue white, mint white, warm white, and cool white.

The LEDs may be distributed about one linear segment of the printed circuit board. Alternatively, the LEDs may be distributed about two linear segments of the printed circuit board that may be positioned substantially parallel to each other. In the latter embodiment, the first set of LEDs may be disposed about the first linear segment, and the second set of LEDs may be disposed about the second linear segment. The printed circuit board may have a reflective layer that reflects light into the optical chamber. The reflective layer may be positioned on the same surface as the LEDs such that the reflective layer does not occlude the LEDs.

The luminaire may have a controller connected to and configured to operate the LEDs to selectively emit light at selected positions along the length of the luminaire. The controller may be configured to control the luminous intensity of light emitted from the LEDs by pulse-width modulation.

The luminaire may have an occupancy sensor that may be configured to determine whether an object is within the field of view of the occupancy sensor, and to transmit to the controller a positive indication that such an object is detected. The controller may operate the light source to illuminate the field of view upon receiving the positive indication. The occupancy sensor also may be configured to determine the position of an object along the length of the luminaire, and may signal the controller to operate the LEDs that are generally adjacent to the same position as the object.

The controller may be configured to communicate with a network using a network interface. The network interface may receive communications across the network and may provide an instruction to the controller to operate the light source responsive to the communication. Multiple luminaires may be positioned in data communication with each other across the network using instructions transmitted by their respective controllers.

The luminaire may have a secondary optic positioned adjacent to the light source. The secondary optic may be configured to attach to the heat sink and/or to the housing to form a seal between the light source and the optical chamber. The secondary optic may configured to collimate, refract, and/or diffuse light emitted by the light source. The primary optic and/or the secondary optic may have a color conversion layer configured to convert a source light emitted by the light source from a first wavelength range to a second wavelength range.

DETAILED DESCRIPTION OF THE INVENTION

Figure 1:
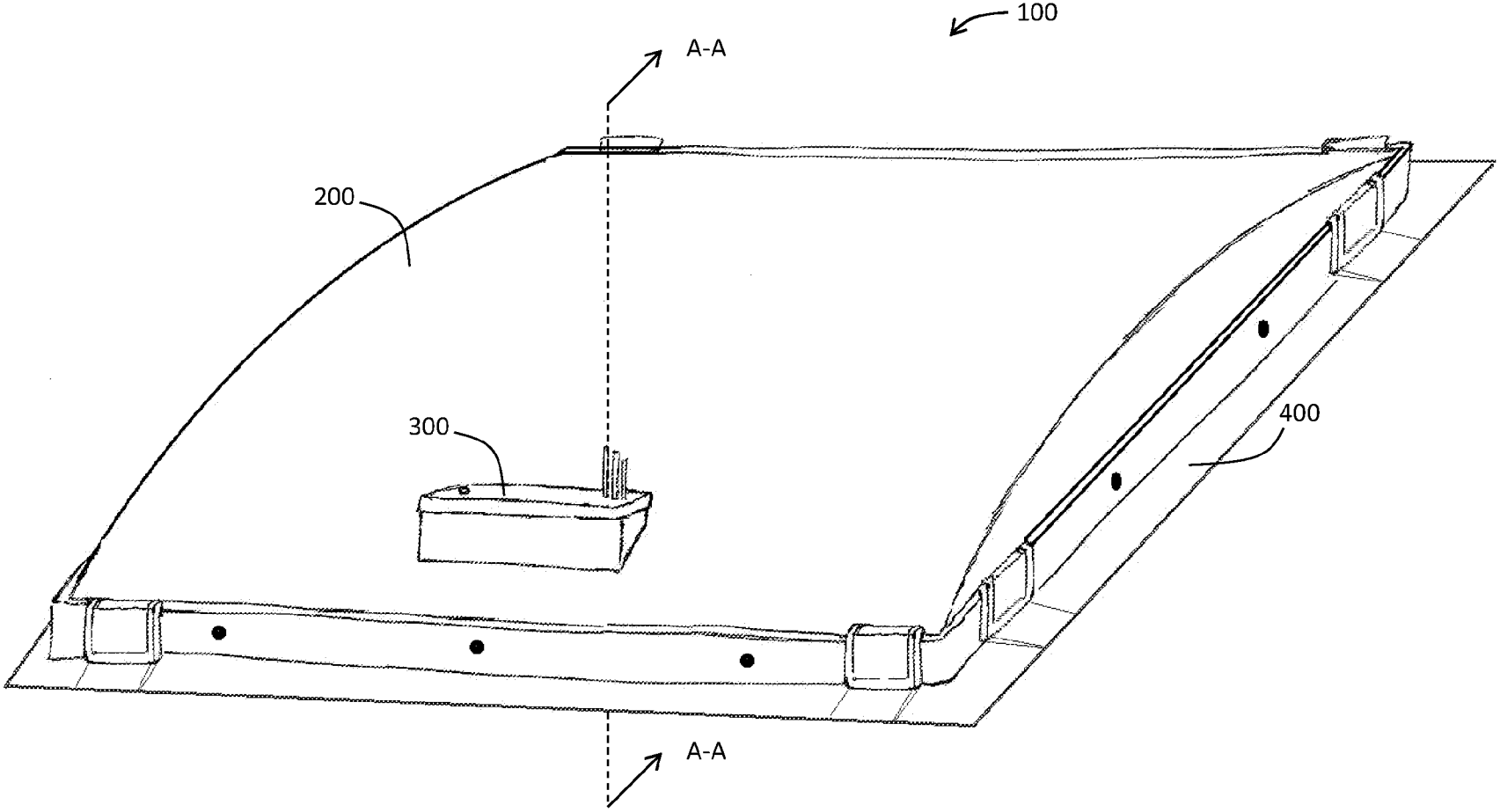
FIG. 1 is a perspective view of a luminaire according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

An embodiment of the invention, as shown and described by the various figures and accompanying text, provides a luminaire configured to be carried by a light fixture. More specifically, referring now to FIG. 1, a luminaire 100 is provided. The luminaire 100 may include a housing 200, an electronics housing member 300 of the housing 200, and a heat sink 400. Additionally, now referring to FIG. 2, the luminaire 100 may further include a light source 500 and a secondary optic 600. The luminaire 100 and its constituent components may be configured to permit the luminaire 100 to be positioned at least partially within and attached to a light fixture such that the luminaire 100 may be carried by the light fixture. In the present embodiment, the luminaire 100 may be configured to be positioned partially within and attached to a troffer lighting fixture.

Figure 2:
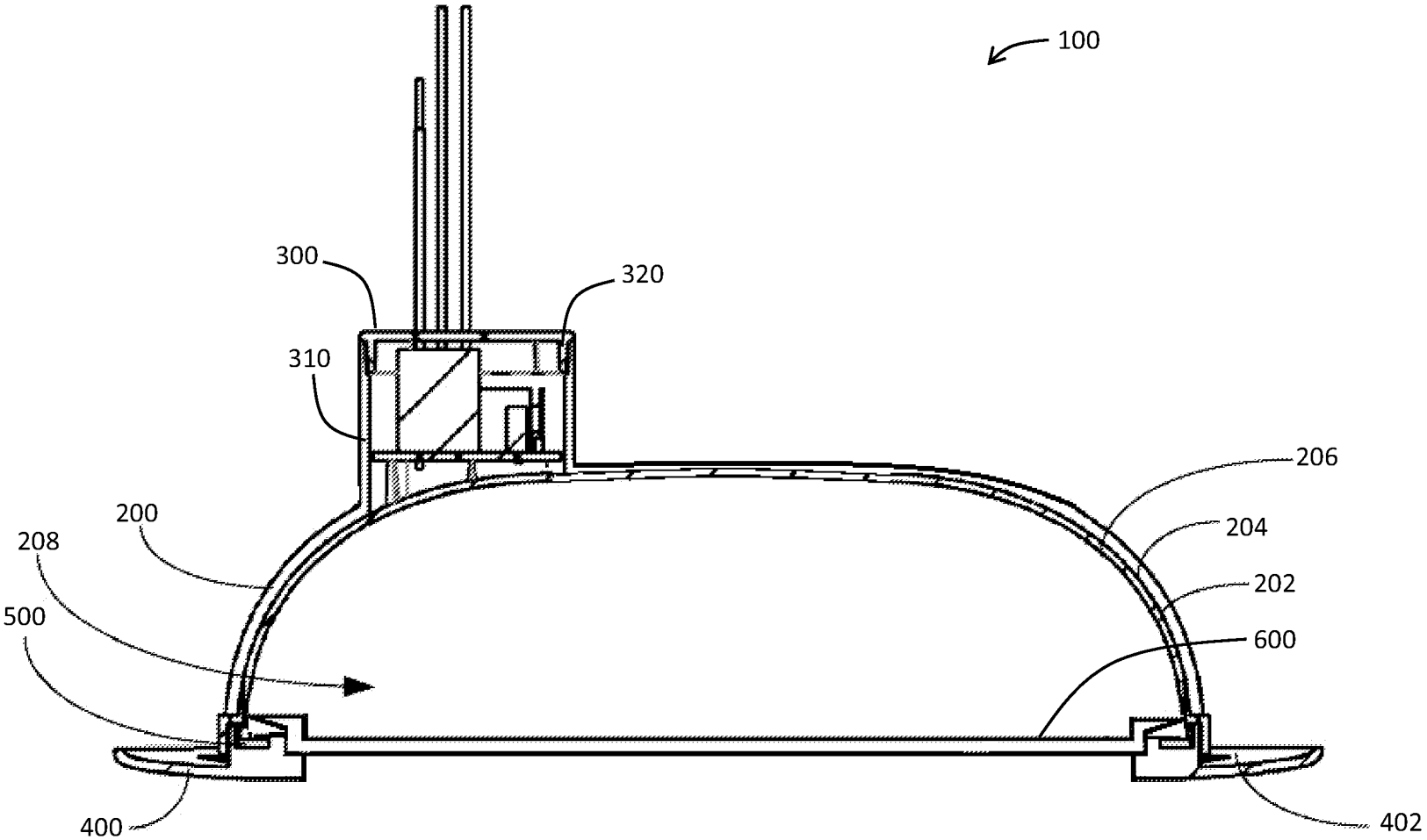
FIG. 2 is a cross-sectional view of the luminaire depicted in FIG. 1 taken through line A-A.

Continuing to refer to FIG. 2, the housing 200 of the present embodiment will now be discussed in greater detail. The housing 200 may be configured to define an interior volume 208. The housing may include a primary optic 202 positioned adjacent to the interior volume 208 of the housing 200. More specifically, the primary optic 202 may be positioned so as to interface with an inner surface 204 of the housing 200.

The primary optic 202 may include a reflective inner surface 206. The reflective inner surface 206 may be configured to reflect light incident thereupon. More specifically, the reflective inner surface 206 may be configured to reflect a light incident thereupon such that the reflected light has an intensity of at least 95% of the intensity of the light before being reflected.

The reflective inner surface 206 may be configured to be reflective by any method known in the art. For example, and without limitation, the primary optic 202 may be formed of a material that is inherently reflective of light, and therefore the inner surface inherently would be reflective. As another example, the primary optic 202 may be formed of a material that may be polished to become reflective. As yet another example, the primary optic 202, or at least an inner surface of the primary optic 202, may be formed of a material that is permissive of a material being coated, attached, or otherwise disposed thereupon, the disposed material being reflective. These methods of forming the reflective inner surface 206 are exemplary only and do not serve to limit the scope of the invention. All methods known in the art of forming a reflective surface are contemplated and included within the scope of the invention.

The reflective inner surface 206 may have an efficiency associated with it. More specifically, the reflective inner surface 206 may reflect light incident thereupon at a percentage of the intensity of the incident light. For example, the reflective inner surface 206 may reflect incident light at about at least 95% of the original intensity. The reflective inner surface 206 may be configured to reflect incident light within an intensity range from about 80% to about 99% of the original intensity.

Additionally, the reflective inner surface 206 may include a color conversion layer. The color conversion layer may be configured to receive a source light having a first wavelength, and to convert the wavelength of source light to a second wavelength, defined as a converted light. The color conversion layer may be constructed of material selected from the group consisting of phosphors, quantum dots, luminescent materials, fluorescent materials, and dyes. More details regarding the enablement and use of a color conversion layer may be found in U.S. patent application Ser. No. 13/073,805, entitled MEMS Wavelength Converting Lighting Device and Associated Methods, filed Mar. 28, 2011, as well as U.S. patent application Ser. No. 13/234,604, entitled Remote Light Wavelength Conversion Device and Associated Methods, filed Sep. 16, 2011, U.S. patent application Ser. No. 13/234,371, entitled Color Conversion Occlusion and Associated Methods, filed Sep. 16, 2011, and U.S. patent application Ser. No. 13/357,283, entitled Dual Characteristic Color Conversion Enclosure and Associated Methods, the entire contents of each of which are incorporated herein by reference.

Additionally, the reflective inner surface 206 may include two or more color conversion layers, wherein each color conversion layer is positioned upon different sections of the reflective inner surface 206. Each of the two or more color conversion layers may convert respective source lights of differing wavelengths to respective converted lights of differing wavelengths. The reflective inner surface 206 may include any number of color conversion layers in any configuration, including overlapping layers.

The primary optic 202 may be configured into any shape. As depicted in FIG. 2, the primary optic 202 may be configured into a three-dimensional geometric shape. More specifically, the primary optic 202 may be configured into a generally domed polygonal shape. In the present embodiment, the primary optic 202 may be configured into a generally rectangular trough shape. Many other shapes of the primary optic 202 are contemplated and included within the scope of the invention, including, without limitation, spherical, conical, cylindrical, parabolic, pyramidal, and any other geometric configuration that may reflect light.

The primary optic 202 may at least partially define an optical chamber 208. In the present embodiment, the primary optic 202 may define an upper portion of the optical chamber 208 that is generally concave, extending upward in the direction of the housing 200. Light that traverses the optical chamber 208 and is incident upon the reflective inner surface 206 may be reflected back into the optical chamber 208 by the reflective inner surface 206. The optical chamber 208 may be configured so as to permit light that propagates through the optical chamber 208 to combine, forming a combined light. The combined light may be a polychromatic light, having multiple constituent wavelengths of light. In some embodiments, the combined light may be a white light. Additional information regarding color combination may be found in U.S. patent application Ser. No. 13/107,928, entitled High Efficacy Lighting Signal Converter and Associated Methods, filed May 15, 2011, as well as U.S. Patent Application Ser. No. 61/643,308, entitled Tunable Light System and Associated Methods, filed May 6, 2012, the entire contents of each of which are incorporated by reference herein.

The primary optic 202 may be configured to have an open end, thereby defining an aperture. The aperture may be configured to permit light traversing the optical chamber 208 to pass therethrough. Furthermore, the aperture may cooperate with additional structures of the luminaire 100 to permit the traversal of light from the optical chamber 208 to the environment.

The primary optic 202 may be configured into a three-dimensional geometric shape so as to control the direction of light reflected from the reflective inner surface 206. For example, the primary optic 202 may be configured to reflect light incident thereupon such that the light is reflected to propagate through the aperture of the primary optic 202.

Figure 3:
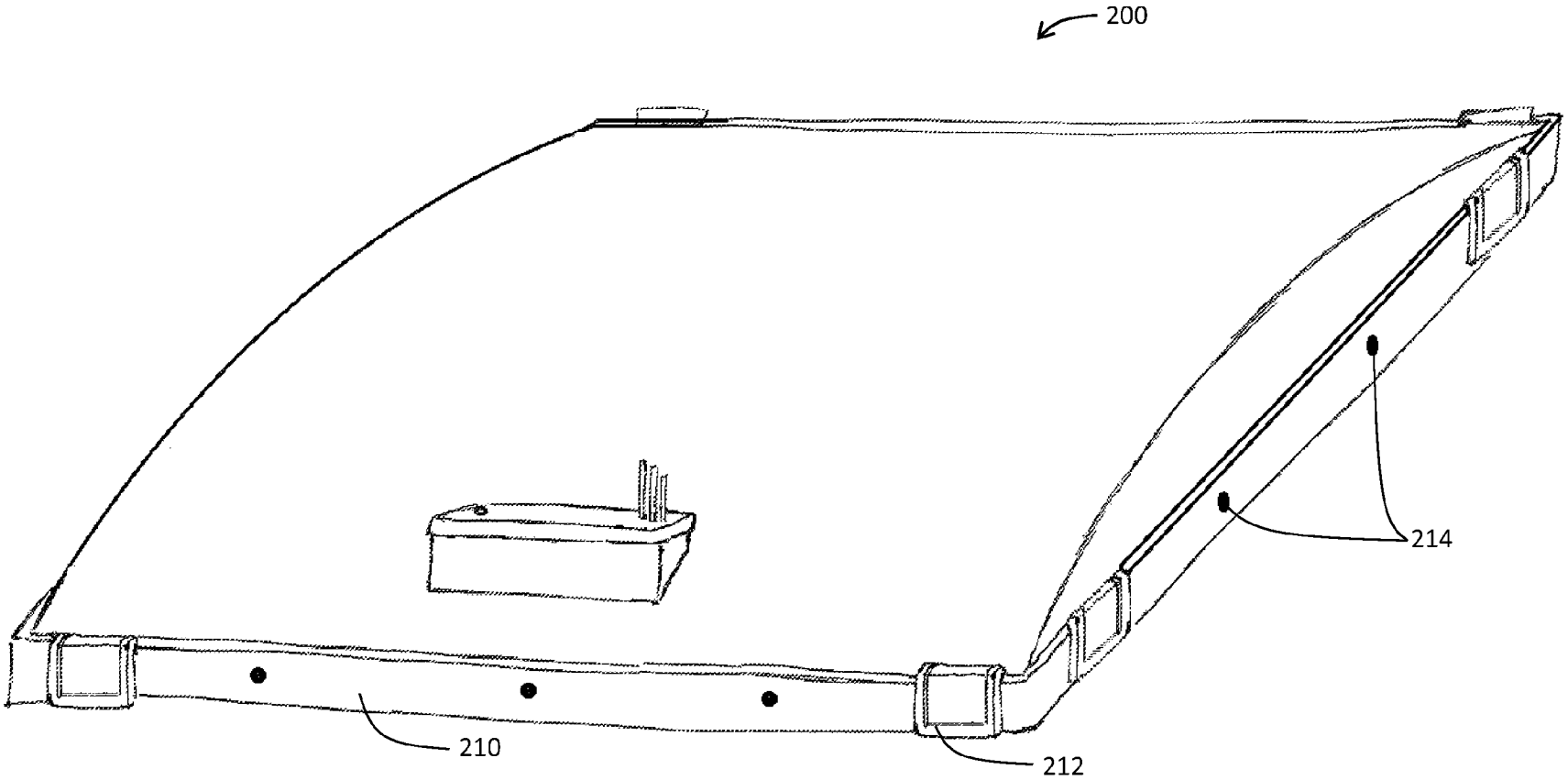
FIG. 3 is a perspective view of a housing of the luminaire depicted in FIG. 1.

Referring now to FIG. 3, and continuing to refer to FIG. 2, the housing 200 will now be discussed in greater detail. The housing 200 may include an attachment section 210. The attachment section 210 may configured to be at a lower end of the housing 200. The attachment section 210 may include heat sink attachment structures 212 and mounting structures 214. Additionally, the housing 200 may further include an electronics housing member 300 formed on an outer surface of the housing 200 and positioned to facilitate establishment of an electrical connection between electronic components within the electronics housing member 300 and electrical devices of the luminaire 100, such as the light source 500.

The heat sink attachment structures 212 may be distributed in a spaced configuration about the attachment section 210. The heat sink attachment structures 212 may be configured to engage with a cooperating structure on the heat sink 400 so as to removably attach the heat sink 400 to the housing 200. As shown in the present embodiment, the heat sink attachment structures 212 may be configured as slots into which clips may be disposed. This embodiment is exemplary only and all methods of removable attachment are contemplated and included within the scope of the invention.

Continuing to refer to FIG. 3, the mounting structures 214 may be distributed in a spaced configuration about the attachment section 210 and may be configured to engage with an existing troffer fixture (not shown). In the present embodiment, the mounting structures 214 are configured as hangar holes permitting attachment in the form of a wire tie or hook mechanism to be disposed in a respective hangar hole. This embodiment is exemplary only and all methods of removable attachment are contemplated and included within the scope of the invention.

Figure 4:
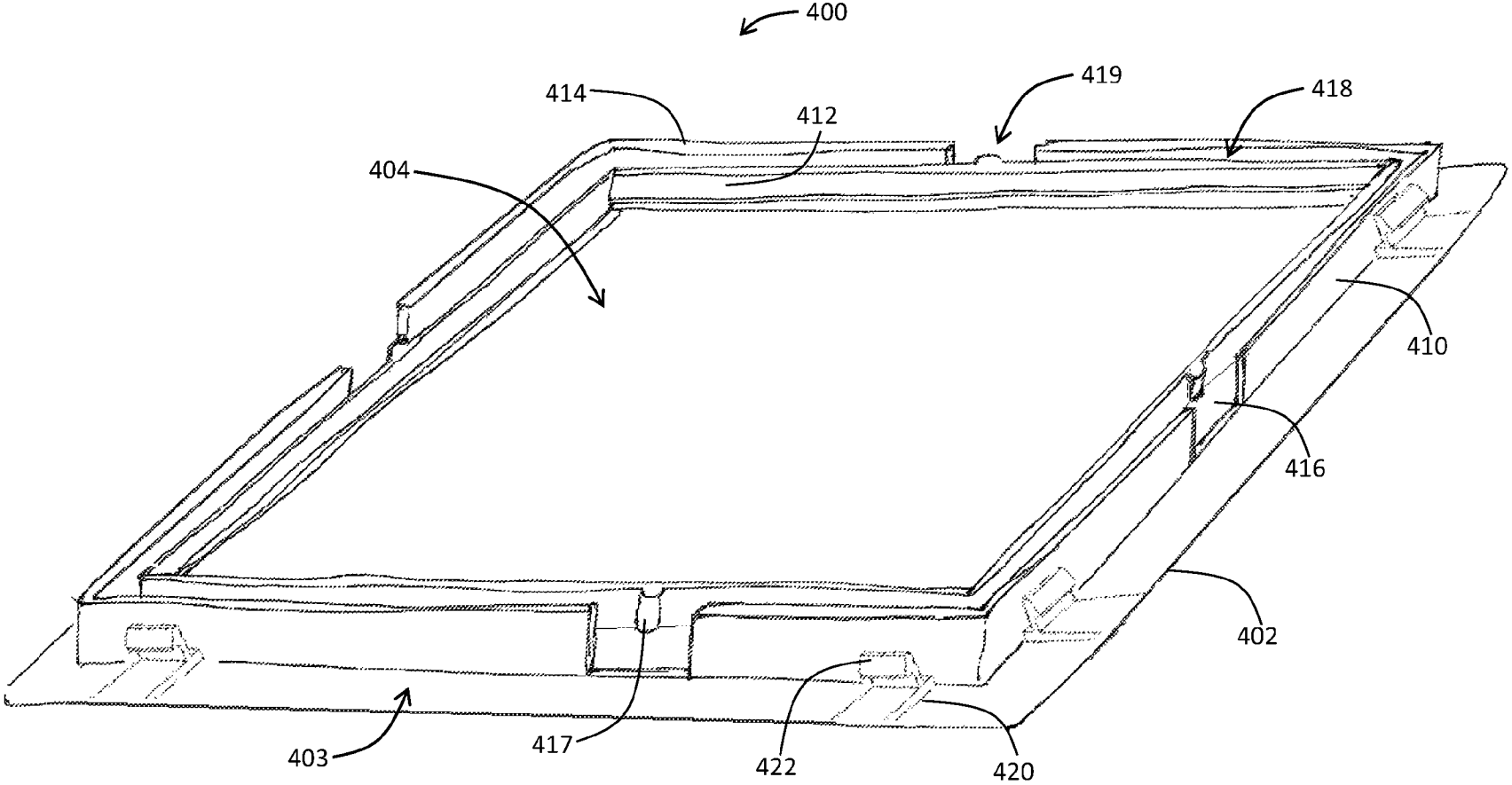
FIG. 4 is a perspective view of a heat sink of the luminaire depicted in FIG. 1.

Referring now to FIG. 4, the heat sink 400 will now be discussed in greater detail. The heat sink 400 may be configured to be thermally coupled to elements of the luminaire 100 so as to increase the thermal dissipation capacity of the luminaire 100. The heat sink 400 may include a body member 402, a support structure 410, and housing attachment structures 420. As shown in FIG. 2, the body member 402 may be configured to cooperate with the primary optic 202 to completely define the optical chamber 208. More specifically, the body member 402 may define the lower boundary of the optical chamber 208.

Referring again to FIG. 3, and continuing to refer to FIG. 4, the body member 402 may be configured to define an aperture 404. The aperture 404 may be a void formed by the body member 402 somewhere within the periphery of the body member 402. In the present embodiment, the aperture 404 may be formed approximately at the center of the body member 402. Furthermore, the aperture 404 may be configured into any geometric configuration. In the present embodiment, the aperture 404 is generally polygonal. More specifically, the aperture 404 may be formed into a generally rectangular configuration. This embodiment is exemplary only, and the aperture 404 may be formed into any other geometric configuration, including, without limitations, ovals, semicircles, triangles, squares, and any other polygon.

The aperture 404 may be configured so as to cooperate with the aperture of the primary optic 202 to permit light that traverses through the aperture of the primary optic 202 to similarly traverse the aperture 404 and to propagate into the environment surrounding the luminaire 100.

The body member 402 may be formed into any geometric configuration. In the present embodiment, the body member 402 is formed into a generally polygonal configuration. More specifically, the body member 402 may be formed into a rectangular configuration. Additionally, due to the positioning of the aperture 404 at the center of the body member 402 and the aperture 404 being configured as a rectangular, the body member 402 may be described as a frame. This embodiment is exemplary only, and the body member 402 may be formed into any other geometric configuration, including, without limitations, ovals, semicircles, triangles, squares, and any other polygon, with the aperture 404 being formed somewhere within the periphery 406 of the geometric configuration employed. Moreover, the body member 402 and the aperture 404 may be selectively formed into identical, similar, or entirely different geometric configurations. In forming each of the body member 402 and the aperture 404, the geometric configuration of a light fixture in which the luminaire 100 may be disposed may be considered.

The body member 402, as well as the other various elements of the heat sink 400 may be formed of a thermally conductive material. Forming the body member 402 of thermally conductive material may increase the thermal dissipation capacity of the heat sink 400 as well as the luminaire 100 generally. Examples of thermally conductive materials include metals, metal alloys, ceramics, and thermally conductive polymers, such as CoolPoly® and Therma-Tech™. This list is not exhaustive, and all other thermally conductive materials are contemplated and within the scope of the invention.

Continuing to refer to FIG. 4, the support structure 410 will now be discussed in greater detail. The support structure 410 may be configured to attach, carry, or otherwise become engaged with various elements of the luminaire 100, including the light source 500 and the secondary optic 600, as shown in FIG. 2. The support structure 410 may be positioned on an interior surface of the body member 402. More specifically, the support structure 410 may be positioned on an interior surface 403 of the body member 402.

Additionally, the support structure 410 may be positioned in a relationship to the aperture 404. In the present embodiment, the support structure 410 may be positioned generally about the aperture 404. More specifically, the support structure 410 may be positioned about the periphery of the aperture 404, generally circumscribing the aperture 404.

Furthermore, the support structure 410 may be positioned so as to result in desirable emission characteristics of the light source 500 where the light source 500 may be engaged with the support structure 410. Accordingly, the support structure 410 may be positioned in relation to emission characteristics of the light source 500 as well as reflective characteristics of the primary optic 202.

Additionally, the support structure 410 may be formed into a geometric configuration. In the present embodiment, the support structure 410 may be formed into a generally rectangular frame configuration. This configuration is exemplary only, and the support structure 410 may be formed into any geometric formation. Moreover, the support structure 410 may be formed into a geometric configuration identical, similar, or different from the geometric configurations of the aperture 404 and/or the body member 402. Additionally, the support structure 410 may be formed into a geometric configuration so as to facilitate engagement with either of the light source 500 or the secondary optic 600, or both.

Continuing to refer to FIG. 3, the support structure 410 may include an anterior wall 412, a posterior wall 414, and a base 416. The anterior wall 412, base 416, and posterior wall 414 may cooperate so as to define a trough 418 therebetween. Additionally, the anterior wall 412 may cooperate in defining the aperture 404. The trough 418 may be configured and dimensioned so as to permit the light source 500 to be disposed therewithin. Additionally, the anterior wall 412 and the posterior wall 414 may be configured so as to permit the secondary optic 600 to be attached thereto. Furthermore, the respective heights of each of the anterior wall 412 and the posterior wall 414 may be configured so as to accommodate a desirable angle of inclination of the secondary optic 600 when the secondary optic 600 is attached thereto. In the present embodiment, the posterior wall 414 may have a height that is greater than the height of the anterior wall 412. Other configurations of the respective and relative heights of the anterior and posterior walls 412, 414 are contemplated and included within the scope of the invention.

As the support structure 410 is part of the heat sink 400, it may be formed of any thermally conductive material describe hereinabove. Moreover, the support structure 410 may be configured to maximize its thermal dissipation capacity. More specifically, the support structure 410 may be configured to maximize the conduction of heat to the body member 402 from any heat-generating element positioned in thermal communication with the support structure 410, such as, for example, the light source 500. Accordingly, the support structure 410 may be configured to maximize the surface area of the interface between the elements of the support structure 410 and the light source 500, providing that such interfacing does not impede the propagation of light emitted by the light source 500.

Additionally, the support structure 410 may include one or more outcroppings 417. The outcroppings 417 may be positioned to extend from the anterior wall 412 into the trough 418. The outcroppings 417 may be configured to interface with the light source 500 when the light source 500 is disposed within the trough 418 so as to desirously position the light source 500 within the trough 418 and/or reduce movement of the light source 500 within the trough 418.

The support structure 410 may include one or more ports 419. The ports may be configured to permit the positioning of an element of the luminaire 100 to traverse an open area that may be positioned generally above the interior surface 403 of the body member 402 and adjacent the trough 418. Accordingly, the ports 419 may be positioned in the posterior wall 414 of the support structure 410. In the present embodiment, the ports 419 may be positioned generally opposite the outcroppings 417.

The heat sink 400 may be configured to be removably attached to the housing 100, as shown in the assembly of FIG. 1. More specifically, the housing attachment structures 420 may be configured to engage with the heat sink attachment structures 212 of the housing 200 so as to removably attach the heat sink 400 to the housing 200. The housing attachment structures 420 may be positioned on the interior surface 403 of the body member 402. In the present embodiment, the housing attachment structures 420 may be clips 422 configured to engage with the slots of the present embodiment of the heat sink attachment structures 212, thereby removably attaching the heat sink 400 to the housing 200. More specifically, the clips 422 may be flexible so as to deflect, permitting the clips 422 to pass by and become disposed within the slots. This may be accomplished by translating the heat sink 400 generally vertically towards the housing 200. Moreover, the heat sink 400 may be detached from the housing 200 by imparting a force onto the heat sink 400 causing the clips 422 to deflect, thereby removing the clips from within the slots and permitting the heat sink 400 to be translated vertically away from the housing 200, thereby detaching the heat sink 400 from the housing 200. This embodiment is exemplary only and all methods and structures of removable attachment are contemplated and included within the scope of the invention.

Figure 5:
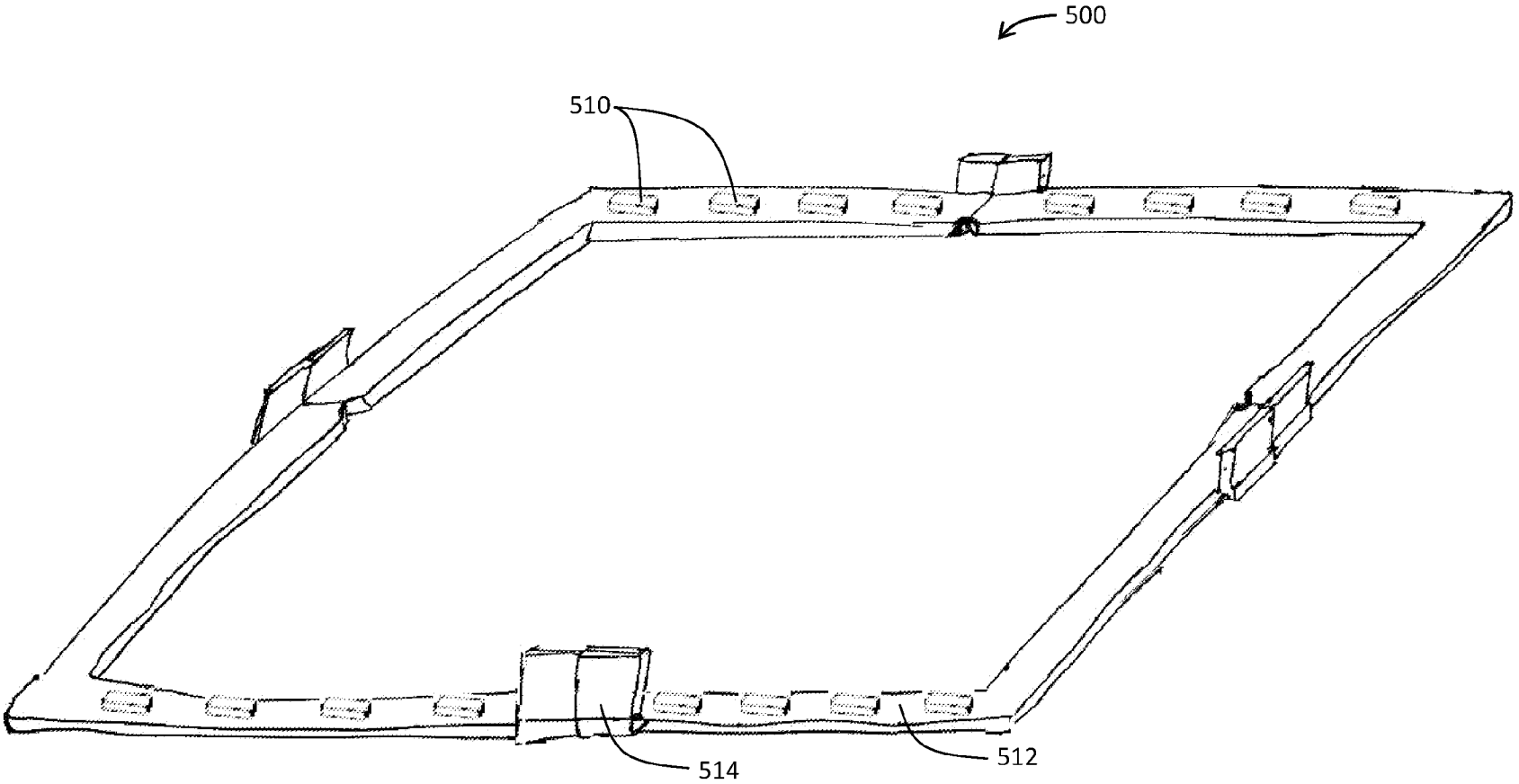
FIG. 5 is a perspective view of a light source of the luminaire depicted in FIG. 1.

Referring now to FIG. 5, the light source 500 will now be discussed in greater detail. As shown in FIG. 2, the light source 500 may be configured to be disposed within the trough 418. Accordingly, the light source 500 may be configured to conform to a geometric configuration. In the present embodiment, the light source 500 may be configured into a generally rectangular frame configuration. This configuration is exemplary only, and the light source 500 may be formed into any geometric frame configuration. Where the light source 500 is positioned within the trough 418, it may be configured into a geometric frame configuration permitting its disposal therewithin. The light source 500 may include one or more light-emitting elements 510. Wherein there are two or more light-emitting elements 510, it will be referred to as a plurality of light emitting elements 510. The light-emitting elements 510 may be operable to emit light. The light-emitting elements 510 may be configured to emit light in a direction so as to propagate into the optical chamber 208.

The light source 500 may be desirously positioned within the luminaire 100. For example, the light source 500 may be positioned within the luminaire 100 such that light that propagates into the environment surrounding the luminaire 100 is generally controlled. As a further example, the light source 500 may be positioned such that the light source 500 is not visible from any point in the environment external the luminaire 100. Similarly, the light source 500 may be positioned such that light emitted from the light source 500 is not directly observable from any point in the environment external the luminaire 100. Instead, any light that is visible from a point in the environment external the luminaire 100 may be reflected at least one, such as light that is reflected from the reflective inner surface 206.

While the current embodiment has specific structural features, such as a generally rectangular frame heat sink 400 having an aperture 404, it is contemplated and within the scope of the invention that the method of indirect lighting disclosed above may be applied to luminaires 100 having different structural features, such as those conforming to form factors including, but not limited to, A19, G25, BR 20, and any other standard for light bulb form known in the industry. Moreover, the use of an optical chamber, such as the optical chamber 208 of the present embodiment, similarly may be included in the alternative form factors, as well as a light source 500 and color conversion layer so as to achieve desirable characteristics of light emitted by the luminaire.

The positioning of the light source 500 and the light-emitting elements 510 may take into account the direction that light emitted therefrom will propagate, as well as any other element or structure of the luminaire 100 with which it may be incident and may interact. Specifically, the light source 500 and plurality of light-emitting elements 510 may be positioned to take into account the incidence of emitted light upon the reflective inner surface 208 and the reflection of the light therefrom. Furthermore, due to the shape of the reflective inner surface 208, the incidence of light emitted from individual light-emitting elements 510 from a certain position may result in light being reflected from the reflective inner surface 208 and propagating therefrom in a predictive direction. As described hereinabove, light reflected from the reflective inner surface 208 may propagate into the environment surrounding the luminaire 100 through the aperture 404 of the heat sink 400.

Accordingly, the light-emitting elements 510 may be positioned such that light emitted from each of the plurality of light-emitting elements may propagate through the aperture 404 and into the environment surrounding the luminaire 100 in a predictive direction. For example, the light emitted from a light-emitting element may be reflected by the reflective inner surface 208 and propagate through the aperture in a direction that is generally radially opposite the radial direction of the light-emitting element 510 relative to a longitudinal axis of the luminaire 100. Additionally, where the plurality of light-emitting elements 510 are positioned in a distributed configuration, as depicted in FIG. 5, each of the light-emitting elements 510 may be selectively operated to redirect the balance of light produced from luminaire 100.

For example, where all of the plurality of light-emitting elements 510 are operated, the light produced by the luminaire 100 may be generally equally distributed about the environment external the luminaire 100, the environment generally defined as a hemisphere beneath the heat sink 400. Where only subsets or individual light-emitting elements 510 are selectively operated, the light produced by the luminaire 100 may be unevenly distributed about the environment external the luminaire 100, such as being distributed more to one side than another, or to form a staggered pattern of lighting. All distributions of light produced by the luminaire 100 into the environment surrounding the luminaire 100 are contemplated and included within the scope of the invention.

Each of the light-emitting elements 510 may emit light within a wavelength range. More specifically, each of the light-emitting elements may emit light having a wavelength range within the wavelength range from about 390 nanometers to about 750 nanometers, commonly referred to as the visible spectrum. Each of the light-emitting elements 510 may emit light having a wavelength range identical or similar to the wavelength range to another of the light-emitting elements 510, or it may emit light having a wavelength range different from another of the light-emitting elements 510.

The selection of light-emitting elements 510 included in the light source 500 may be made so as to produce a desirous combined light, as described hereinabove. Accordingly, the light source 500 may include light-emitting elements 510 that produce light having a variety of wavelengths such that the emitted light combines in the optical chamber 208 to form a combined polychromatic light. In some embodiments, the combined light may be observed by an observer in the environment external the luminaire 100 as a generally white light. Moreover, the combined light may have desirous characteristics, such as certain color temperatures and color rendering indices. The methods of forming such a combined light are discussed in the references incorporated by reference hereinabove. For example, the light source 500 may include light-emitting elements 510 that emit light that combines to produce a combined light that is generally white in color or any other color such as those represented on the 1931 CIE color space, having a color temperature within the range from about 2,000 Kelvin to about 25,000 Kelvin, and/or having a color-ing rendering index within the range from about 15 to about 100. Moreover, in addition to including light-emitting elements 510 to produce a combined light having desirous characteristics, the luminaire 100 may include one or more color conversion layers configured to convert light from a first source wavelength to a second converted wavelength as described in greater detail hereinabove and hereinbelow.

The light-emitting elements 510 may be any device capable of or method of emitting light. Such devices and methods include, without limitation, incandescent light bulbs, fluorescent lights, light-emitting semiconductors, arc lamps, and any other devices and methods known in the art. In the present embodiment, the light-emitting elements 510 are light-emitting semiconductors, more specifically, light-emitting diodes (LEDs). Additionally, as in the present embodiment, where the light-emitting elements 510 are LEDs, the light source 500 may further include a printed circuit board 512. The printed circuit board 512 may include necessary circuitry so as to enable the operation of the LEDs. Furthermore, the printed circuit board 512 may include the necessary circuitry so as to enable individual operation of each of the LEDs. Other embodiments of the light source 500 may include light-emitting elements 510 other than LEDs, but may include a structure similar to the printed circuit board 512 that enables the operation of the light-emitting elements 510.

In the present embodiment, the printed circuit board 512 may generally define the shape of the light source 500. Accordingly, the printed circuit board 512 may be configured to have a geometric frame configuration substantially as described for the light source 500 described hereinabove.

In the present embodiment, the LEDs 510 may be disposed on and operably coupled to the printed circuit board 512. The LEDs 510 may be distributed about the printed circuit board 512 in any desirable pattern, configuration, or arrangement. For example, where the printed circuit board 512 may be divided into two sides, one side of the printed circuit board 512 may have disposed thereon more LEDs 510 than on the other side. As another example, the LEDs 510 may be distributed about the printed circuit board 512 substantially evenly. It is contemplated by the invention that the distribution of LEDs 510 on the printed circuit board 512, and the distribution of light-emitting elements generally, may affect the propagation of light into the optical chamber, the intensity of light incident upon various sections of the primary optic 202, and the light emission characteristics of the luminaire 100. Additionally, wherein the LEDs 510 include LEDs that emit light within different wavelength ranges, the distribution of the LEDs 510 with differing wavelength ranges may similarly affect the light emission characteristics of the luminaire 100.

The printed circuit board 512 may further include electrical contacts 514. The electrical contacts 514 may be electrically connected to each of the LEDs 510, thereby enabling the operation of the LEDs 510. Additionally, the electrical contacts 514 may be configured to interface with and electrically couple to an electrical connector that can supply electrical power to the electrical contacts 514, thereby enabling the operation of the LEDs 510. Additionally, the electrical contacts 514 may be configured to enable the selective operation of each of the LEDs 510 by permitting operating signals to be transmitted therethrough.

In some embodiments, the printed circuit board 512 may include a reflective surface. The reflective surface may be on a surface to which the LEDs 510 are attached or adjacent to, in any case the surface of the printed circuit board 512 upon which light emitted by the LEDs 510 is incident upon. The reflective surface of the printed circuit board 512 may reflect light incident thereupon back into the optical chamber 208, thereby reducing the loss of light that would not otherwise be reflected by the printed circuit board 512.

Figure 6:
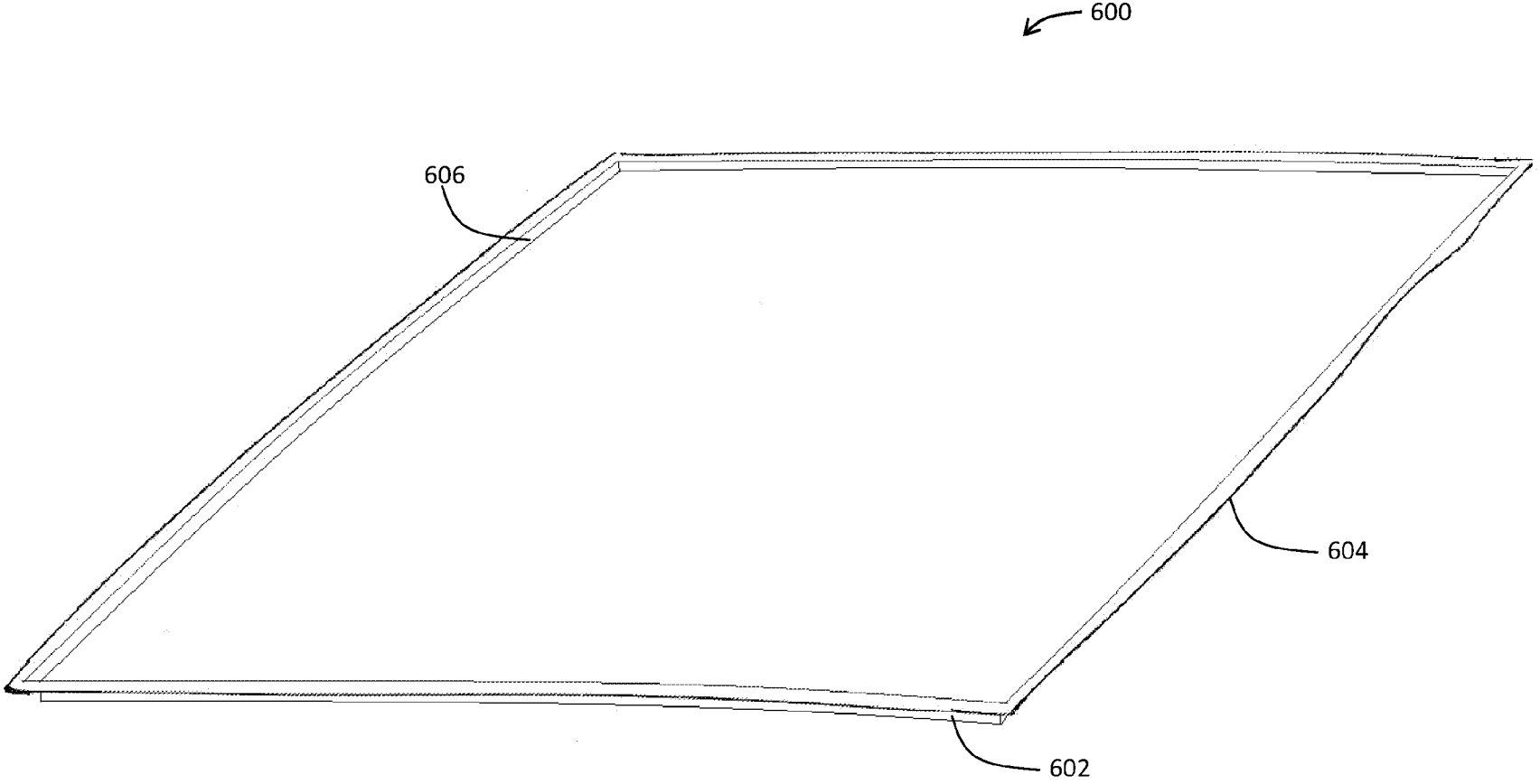
FIG. 6 is a perspective view of a secondary optic of the luminaire depicted in FIG. 1.

Referring now to FIG. 6, the secondary optic 600 of the present embodiment will now be discussed in greater detail. As shown in FIG. 2, the secondary optic 600 may be configured to be disposed in relation to the light source 500 such that light emitted from the light-emitting elements 510 is incident upon the secondary optic 600. Accordingly, the secondary optic 600 may be formed into a geometric configuration that is generally similar to the geometric frame configuration of the light source 500. In the present embodiment, the secondary optic 600 may formed into a rectangular configuration. This configuration is exemplary only, and the secondary optic 600 may be formed into any geometric configuration.

Additionally, the secondary optic 600 may be configured to shield the light source 500 from the environment of the optical chamber 208, which may be in communication with the environment external the luminaire 100. Referring again to FIG. 2, the secondary optic 600 may interface with a seating structure of the heat sink 400 so as to form a seal therebetween, shielding the optical chamber 208 of the light source 500 from the environment surrounding the luminaire 100. More specifically, as described hereinabove, the secondary optic 600 may include an anterior edge 602 and a posterior edge 604. The anterior edge 602 may be configured to interface with and attach to the anterior wall 412 of the heat sink 400, and the posterior edge 604 may be configured to interface with and attach to the posterior wall 414 of the heat sink 400, thereby forming the aforementioned seal. Additionally, the secondary optic 600 may be carried by the heat sink 400 by the attachment between the anterior and posterior edges 602, 604, to the anterior and posterior walls 412, 414, respectively.

The secondary optic 600 may be configured to refract light incident upon it. As in the present embodiment, the secondary optic 600 may include an outer surface 606 having plurality of approximately orthogonal sections formed therein. The orthogonal sections may be configured to desirously refract light incident thereupon. Additionally, in some embodiments, the orthogonal sections may be configured to collimate light incident thereupon, such as light emitted by the light source 500. The structure and use of a refracting optic is described in U.S. Patent Application Ser. No. 61/642,205, entitled Luminaire with Prismatic Optic, filed May 3, 2012, which is incorporated herein by reference. Moreover, the secondary optic 600 may be formed so as to refract light incident thereupon from one of the plurality light-emitting elements 510 so as to refract the incident light in a desirous direction. Further, the direction of the refraction may be configured to cause the refracted light to propagate through the optical chamber 208 such that the refracted light is incident upon a desirous section of the reflecting inner surface 206. Yet further, the direction of the refraction may result in the propagation of the refracted-reflected light into the environment surrounding the luminaire 100 in a desirous direction.

In some embodiments, the secondary optic 600 may include a color conversion layer. The color conversion layer of the secondary optic 600 may be configured similarly to the color conversion layer as described for the reflective inner surface 206 of the primary optic 202.

Referring again to FIGS. 1 and 2, the electronics housing member 300 will now be discussed in greater detail. The electronics housing member 300 may be positioned on the outer surface of the housing 200, the outer surface being generally opposite the reflective inner surface 206. The electronics housing member 300 may be configured to permit electronic components necessary to enable the operation of the luminaire to be disposed therein. The electronics housing member 300 may include a walled portion 310 that is attached at a first end to the outer surface of the housing 200, and a cap 320 that is configured to attach to a second end of the walled portion 310. The walled portion 310 and the cap 320 may cooperate so as to define an internal volume of the electronics housing member 300 wherein the electronic components may be positioned. The cap 320 may further include one or more apertures to enable the wired connection of electronic components disposed within the electronics housing member 300 with devices external the luminaire 100. The walled portion 310 may be formed as a separate structure from the housing 200, or it may be formed as an integral member of the housing 200.

Additional details regarding the electronics housing member 300 and electronics that may be disposed therein may be found in U.S. patent application Ser. No. 13/676,539 titled Low Profile Light Having Concave Reflector and Associated Methods filed on Nov. 14, 2012, as well as in U.S. patent application Ser. No. 13/476,388 titled Low Profile Light and Accessory Kit For The Same filed on May 21, 2012, in U.S. patent application Ser. No. 12/775,310, now U.S. Pat. No. 8,201,968, titled Low Profile Light filed on May 6, 2010, and in U.S. Provisional Patent Application Ser. No. 61/248,665 filed Oct. 5, 2009, the entire contents of each of which are incorporated herein by reference.

Figure 7:
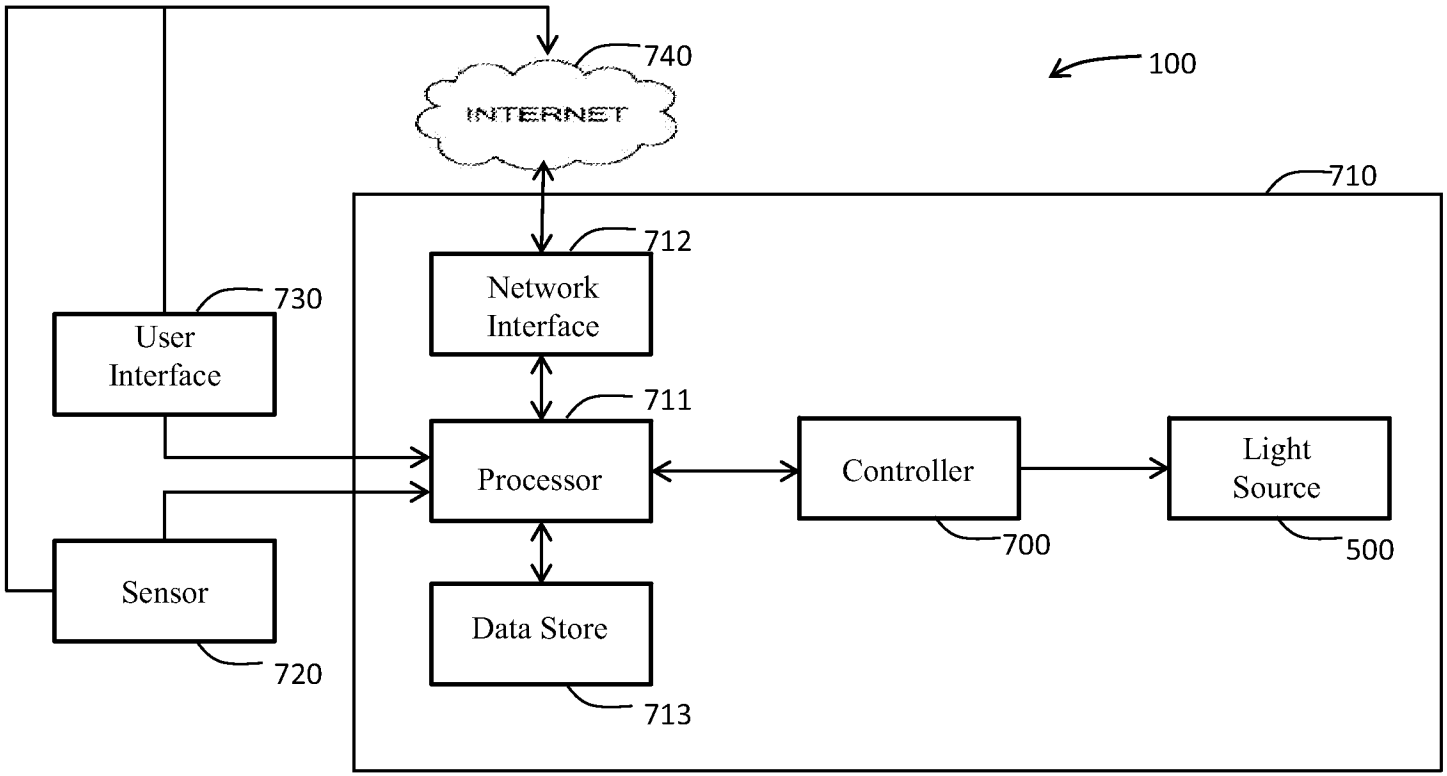
FIG. 7 is a block diagram of a luminaire according to an embodiment of the present invention.

Referring now to FIG. 7, the logical components of a luminaire 100 may comprise a lighting device 710 that may include a controller 700 and the light source 500. The controller 700 may be designed to control the characteristics of a source light emitted by the light source 500. The lighting device 710 also may comprise a processor 711 that may accept and execute computerized instructions, and also a data store 713 which may store data and instructions used by the processor 711. More specifically, the processor 711 may be configured to receive the input transmitted from some number of input devices 720, 730 and to direct that input to a data store 713 for storage and subsequent retrieval. For example, and without limitation, the processor 711 may be in data communication with the input device 720, 730 through a direct connection and/or through a network interface 712.

The controller 700 may be operably connected to the light source 500 so as to control the operation of the light source 500. The controller 700 may be configured to operate the light source 500 between operating and non-operating states, wherein the light source 500 emits light when operating, and does not emit light when not operating. Referring additionally to FIG. 5, where the light source 500 includes a plurality of light-emitting elements 510, the controller 700 may be operably connected to the plurality of light emitting elements 510. Furthermore, the controller 700 may be operably connected to the plurality of light-emitting elements 510 so as to selectively operate each of the plurality of light-emitting elements 510. Accordingly, the controller 700 may be configured to operate the light-emitting elements 510 as described hereinabove. Moreover, the controller 700 may be configured to operate the light-emitting elements 510 so as to control the color, color temperature, and distribution of light produced by the luminaire 100 into the environment surrounding the luminaire 100 as described hereinabove.

In addition to selective operation of each of the plurality of light-emitting elements 510, the controller 700 may be configured to operate each of the plurality of light-emitting elements 510 so as to cause each light-emitting element 510 to emit light either at a full intensity or a fraction thereof. Many methods of dimming, or reducing the intensity of light emitted by a light-emitting element, are known in the art. Where the light-emitting elements 510 are LEDs, the controller 700 may use any method of dimming known in the art, including, without limitation, pulse-width modulation (PWM) and pulse-duration modulation (PDM). This list is exemplary only and all other methods of dimming a light-emitting element is contemplated and within the scope of the invention. Further disclosure regarding PWM may be found in U.S. patent application Ser. No. 13/073,805, the entire contents of which are incorporated by reference hereinabove.

In some embodiments, the luminaire 100 may further include a sensor 720. The sensor 720 may be configured to affect the operation of the light source 500. For example, the sensor 720 may be in electrical communication with a controller 700 as described hereinabove. The sensor 720 may transmit a signal to the controller 700 indicating that the controller 700 should either operate the light source 500 or cease operation of the light source 500. For example, the sensor 720 may be an occupancy sensor that detects the presence of a person within a field of view of the occupancy sensor. When a person is detected, the occupancy sensor 720 may indicate to the controller 700 that the light source 500 should be operated so as to provide lighting for the detected person. Accordingly, the controller 700 may operate the light source 500 so as to provide lighting for the detected person. Furthermore, the occupancy sensor 720 may either indicate that lighting is no longer required when a person is no longer detected, or either of the occupancy sensor or the controller 700 may indicate lighting is no longer required after a period of time transpires during which a person is not detected by the occupancy sensor. Accordingly, in either situation, the controller 700 may cease operation of the light source 500, terminating lighting of the environment surrounding the luminaire 100. The sensor 720 may be any sensor capable of detecting the presence or non-presence of a person in the environment surrounding the luminaire 100, including, without limitation, infrared sensors, motion detectors, and any other sensor of similar function known in the art. More disclosure regarding motion-sensing luminaires and occupancy sensors may be found in U.S. patent application Ser. No. 13/403,531, entitled Configurable Environmental Sensing Luminaire, System and Associated Methods, filed Feb. 23, 2012, and U.S. patent application Ser. No. 13/464,345, entitled Occupancy Sensor and Associated Methods, filed May 4, 2012, the entire contents of both of which are herein incorporated by reference.

Additionally, the luminaire 100 may further include a network interface 712. The network interface 712 may be configured to establish connection with a network 740 and communicate with other electronic devices similarly connected to the network 740 there across. Furthermore, the network interface 712 may be in communication with the various electronic components and devices of the luminaire 100, thereby enabling the various electronic components and devices of the luminaire 100 to communicate with other electronic devices across the network 720. For example, the network interface 712 may connect to a network of a plurality of luminaires 100 according to the present invention. Furthermore, the luminaire 100 may be configured to transmit and/or receive signals across the network 740 via the network interface 712 affecting the operation of light source 500. For example, the luminaire 100, or more specifically an electronic device of the luminaire, such as a controller 700, may be placed in communication with the network interface 712 and receive a signal across the network 740 containing an instruction to either operate or cease operation of the light source 500. The controller 700 may then operate the light source 500 responsive to the received signal. Furthermore, the controller 700 may similarly transmit a signal to other luminaires across the network 740 with a similar instruction to either operate or cease operation of the luminaires' respective light sources. More disclosure regarding networked lighting and attending luminaires may be found in U.S. patent application Ser. No. 13/463,020, entitled Wireless Pairing System and Associated Methods, filed May 3, 2012 and U.S. patent application Ser. No. 13/465,921, entitled Sustainable Outdoor Lighting System and Associated Methods, filed May 7, 2012, the entire contents of both of which are incorporated herein by reference.

Figure 8:
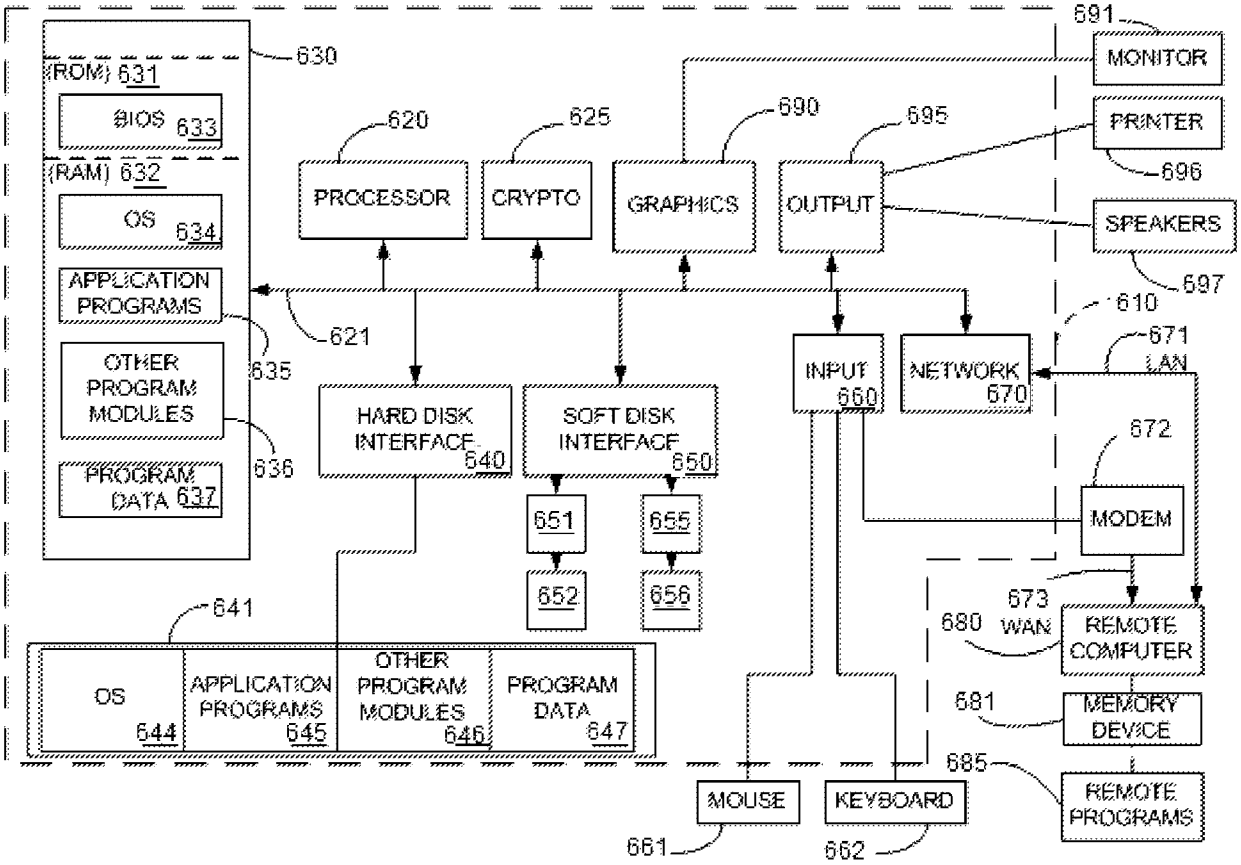
FIG. 8 is a block diagram representation of a machine in the example form of a computer system according to an embodiment of the present invention.

A skilled artisan will note that one or more of the aspects of the present invention may be performed on a computing device. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 8 illustrates a model computing device in the form of a computer 610, which is capable of performing one or more computer-implemented steps in practicing the method aspects of the present invention. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 610 may also include a cryptographic unit 625. Briefly, the cryptographic unit 625 has a calculation function that may be used to verify digital signatures, calculate hashes, digitally sign hash values, and encrypt or decrypt data. The cryptographic unit 625 may also have a protected memory for storing keys and other secret data. In other embodiments, the functions of the cryptographic unit may be instantiated in software and run via the operating system.

A computer 610 typically includes a variety of computer readable media. Computer readable media can be any available media that can be accessed by a computer 610 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 610. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 8 illustrates an operating system (OS) 634, application programs 635, other program modules 636, and program data 637.

The computer 610 may also include other removable/non-removable, volatile/nonvolatile computer storage media. By way of example only, FIG. 8 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives, and their associated computer storage media discussed above and illustrated in FIG. 8, provide storage of computer readable instructions, data structures, program modules and other data for the computer 610. In FIG. 8, for example, hard disk drive 641 is illustrated as storing an OS 644, application programs 645, other program modules 646, and program data 647. Note that these components can either be the same as or different from OS 633, application programs 633, other program modules 636, and program data 637. The OS 644, application programs 645, other program modules 646, and program data 647 are given different numbers here to illustrate that, at a minimum, they may be different copies. A user may enter commands and information into the computer 610 through input devices such as a keyboard 662 and cursor control device 661, commonly referred to as a mouse, trackball or touch pad. Other input devices (not shown) may include a microphone, joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a graphics controller 690. In addition to the monitor, computers may also include other peripheral output devices such as speakers 697 and printer 696, which may be connected through an output peripheral interface 695.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 8. The logical connections depicted in FIG. 8 include a local area network (LAN) 671 and a wide area network (WAN) 673, but may also include other networks 140. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660, or other appropriate mechanism. In a networked environment, program modules depicted relative to the computer 610, or portions thereof, may be stored in the remote memory storage device. By way of example, and not limitation, FIG. 8 illustrates remote application programs 685 as residing on memory device 681.

The communications connections 670 and 672 allow the device to communicate with other devices. The communications connections 670 and 672 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A luminaire adapted to be carried by a light fixture comprising:

a housing;

a primary optic disposed within the housing having a reflective inner surface and a generally elongated shape defining an optical chamber and an aperture;

a light source;

a heat sink;

a secondary optic positioned adjacent to the light source; and a plurality of hanger holes;

wherein the light source is positioned in thermal communication with the heat sink;

wherein light emitted by the light source enters the optical chamber incident upon the reflective inner surface of the primary optic, and is reflected through the aperture;

wherein the secondary optic is configured to attach to the heat sink and form a seal between the light source and the optical chamber;

wherein the primary optic further comprises an attachment structure positioned on the outer surface of the primary optic; and wherein each of the plurality of hanger holes is configured to attach to an external light fixture.

2. A luminaire according to claim 1 further comprising an occupancy sensor having a field of view;

wherein the controller is in communication with the occupancy sensor;

wherein the occupancy sensor is configured to determine whether an object is within the field of view of the occupancy sensor;

wherein the occupancy sensor is configured to transmit a positive indication when an object is determined to be within the field of view; and wherein the controller is configured to operate the light source to illuminate the field of view of the occupancy sensor upon receiving the positive indication.

3. A luminaire according to claim 2 wherein the occupancy sensor is configured to determine the position of the object along the length of the luminaire; and wherein the controller is configured to operate the plurality of LEDs adjacent to the same position as the object along the length of the luminaire.

4. A luminaire according to claim 1 further comprising a network interface configured to enable communication with a network;

wherein the controller is in communication with the network interface;

wherein the network interface is operable to receive communications across the network and provide an instruction to the controller; and wherein the controller operates the light source responsive to the instruction received from the network interface.

5. A luminaire according to claim 4 wherein the network comprises a plurality of luminaires; wherein the controller is operable to send an instruction to the network interface; and wherein the network interface is operable to transmit the instruction to each of the plurality of luminaires across the network.

* * * * *